US005740573A

United States Patent [19]

Boyd

[11] Patent Number: 5,740,573

[45] Date of Patent: Apr. 21, 1998

[54] AIR BED WITH CIRCUMFERENTIAL BELT

[76] Inventor: Dennis Boyd, 14457 Rouge River, Chesterfield, Mo. 63017

[21] Appl. No.: 892,926

[22] Filed: Jul. 15, 1997

[51] Int. Cl.[6] ..... A47C 27/10; A47C 27/08

[52] U.S. Cl. ..... 5/711; 5/706; 5/685

[58] Field of Search ..... 5/711, 710, 706, 5/681, 685, 713

[56] References Cited

U.S. PATENT DOCUMENTS

| | | | |
|---|---|---|---|
| 3,705,429 | 12/1972 | Nail | 5/710 |
| 3,766,579 | 10/1973 | Shields | 5/681 |
| 4,306,322 | 12/1981 | Young et al. | 5/706 |
| 4,644,597 | 2/1987 | Walker | 5/711 |
| 5,115,526 | 5/1992 | Boyd | 5/681 |
| 5,311,623 | 5/1994 | Hendi | 5/710 |
| 5,375,273 | 12/1994 | Bodine, Jr. et al. | 5/710 |
| 5,490,295 | 2/1996 | Boyd | 5/711 |

*Primary Examiner*—Alexander Grosz

*Attorney, Agent, or Firm*—Polster, Lieder, Woodruff & Lucchesi, L.C.

[57] ABSTRACT

An air bed includes first and second air-tight enclosures disposed side by side in a first plane. Each of the first and second air-tight enclosures is independently inflatable and has substantially the same length and width, the first and second air-tight enclosures together having a first cross-sectional area in the first plane. An inflatable foundation is disposed below the first and second air-tight enclosures in a second plane substantially parallel to the first plane. The inflatable foundation has a cross-sectional area in the second plane at least as great as the first cross-sectional area. The inflatable foundation is independently inflatable with respect to the first and second air-tight enclosures. The first and second air-tight enclosures and the inflatable foundation are secured together by a circumferential belt, with the first and second air-tight enclosures fixed in place with respect to the inflatable foundation.

16 Claims, 2 Drawing Sheets

AIR BED WITH CIRCUMFERENTIAL BELT

STATEMENT REGARDING FEDERALLY SPONSORED RESEARCH OR CLAIM

Not applicable.

CROSS-REFERENCE TO RELATED APPLICATIONS

Not applicable.

BACKGROUND OF THE INVENTION

The present invention relates to air beds generally, and more particularly to an improved air bed with independently inflatable sections.

Air beds having independently inflatable mattresses for separate sleepers are known, but they could be improved. For example, currently available air mattresses may "bottom out" when the weight thereon is too high, resulting in an uncomfortable mattress. Single mattresses or pairs of independently inflatable mattresses connected together may also create a rolling effect when one person lays down on the bed, resulting in the other person being jostled. Moreover, the support in many convention air mattresses is not always satisfactory.

SUMMARY OF THE INVENTION

Among the various objects and features of the present invention may be noted the provision of an air bed with improved comfort.

A second object is the provision of such an air bed which allows each user to have individual support, comfort, and adjustability.

A third object is the provision of such an air bed which effectively isolates portions of the air bed so that movement on one part of the air bed does not affect a person on another portion of the air bed.

Other objects and features will be in part apparent and in part pointed out hereinafter.

Briefly, an air bed of the present invention includes first and second air-tight enclosures disposed side by side in a first plane, each of the first and second air-tight enclosures being independently inflatable and having substantially the same length and width. The first and second air-tight enclosures together have a first cross-sectional area in the first plane. An inflatable foundation is disposed below the first and second air-tight enclosures in a second plane substantially parallel to the first plane, the inflatable foundation having a cross-sectional area in the second plane at least as great as the first cross-sectional area. The foundation is independently inflatable with respect to the first and second air-tight enclosures. The first and second air-tight enclosures and the inflatable foundation are secured together with the first and second air-tight enclosures fixed in place with respect to the inflatable foundation.

BRIEF DESCRIPTION OF THE DRAWINGS

Similar reference characters indicate similar parts throughout the several views of the drawings.

DETAILED DESCRIPTION OF THE INVENTION

Turning to the drawings, an air bed 11 of is shown to include a first air mattress 13 and a second air mattress 15 which are air-tight and disposed side by side each other. Mattresses 13 and 15 are independently inflatable by means of suitable valves 17 and 19, which are preferably double valves having a reverse flow inhibitor. It is well known in the art that these valves (sometimes known as Boston valves) simplify the filling of air mattresses and avoid air flowing the mattress exiting from the valve. Each mattress 13 and 15 is substantially the same size (length, height, and width), and together they provide the cross-sectional sleeping area of the air bed. The provision of dual mattresses provides individual support, comfort, and adjustability for the user.

Figure 1:
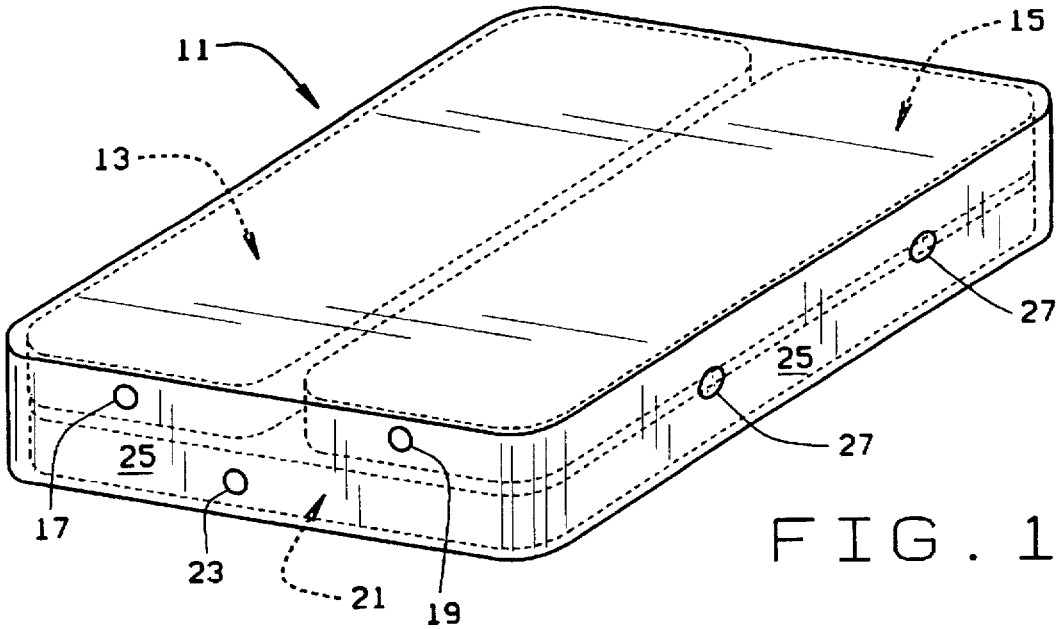
FIG. 1 is a perspective view of an air bed of the present invention.
Figure 3:
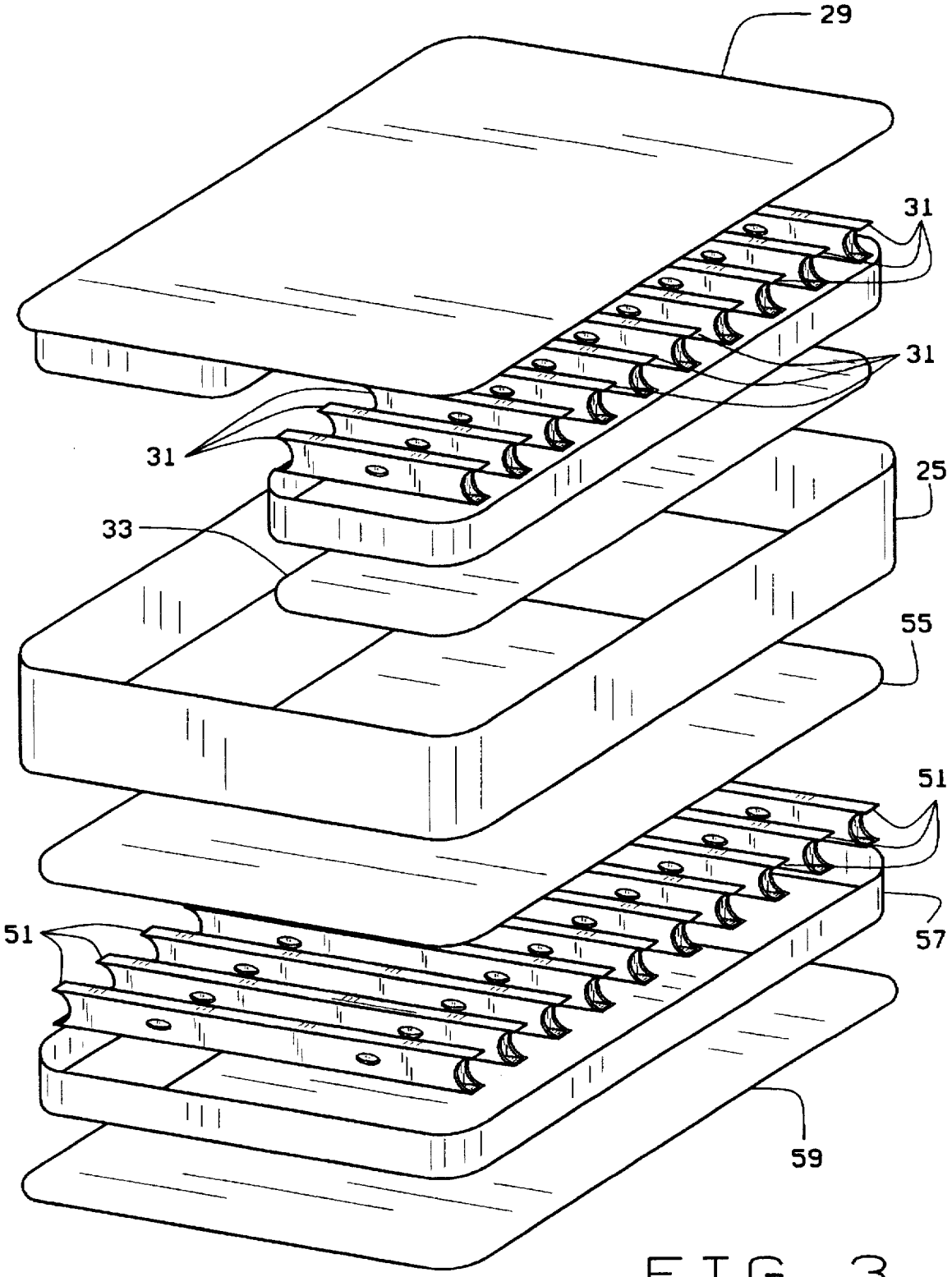
FIG. 3 is an exploded view of the air bed of FIG. 1.

An inflatable foundation 21 is disposed below mattress 13 and 15. Foundation 21 provides added comfort since as a body sinks to that level in the overlying air mattress additional support is provided by the foundation. Foundation 21 is disposed generally parallel to the mattresses and has an area which at least equals that of the mattresses 13 and 15 combined. Foundation 21 is independently inflatable, by means of a third valve 23, with respect to the first and second air-tight enclosures. As indicated in FIG. 1 and as best seen in FIG. 3, a belt or side panel 25 secures mattresses 13 and 15 and foundation 21 together with the mattresses fixed in place with respect to the inflatable foundation. One or more vents 27 disposed in side panel 25 allow air to flow in and out of the air mattress without any change in the inflation of the air mattresses or of the foundation.

Figure 2:
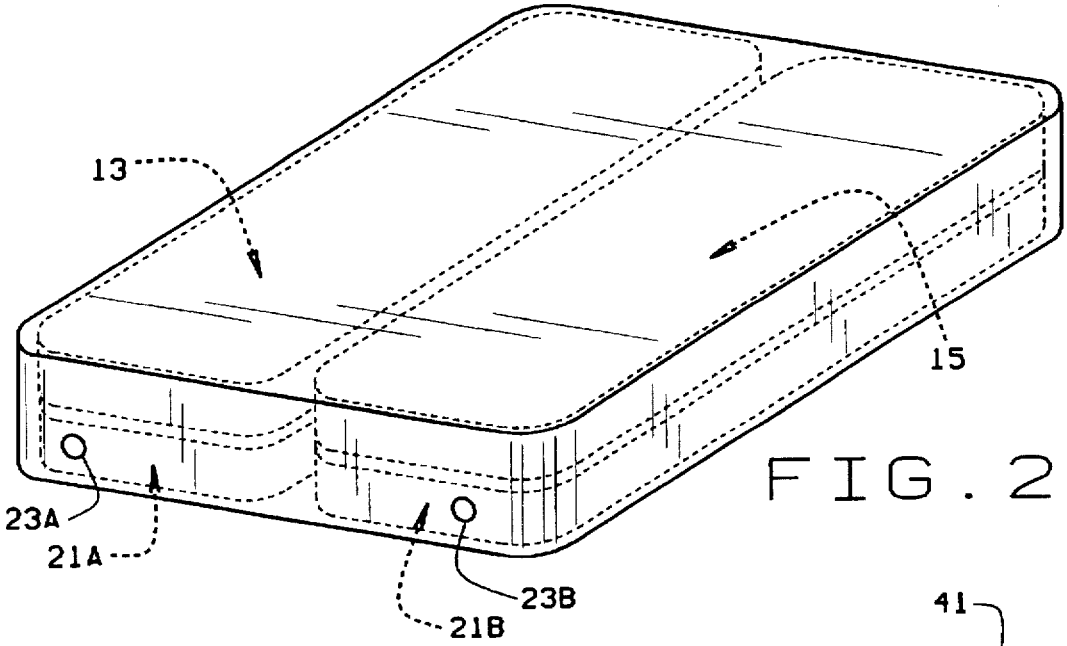
FIG. 2 is a view similar to FIG. 1 showing an alternative construction.

Although foundation 21 is shown in FIG. 1 as a single inflatable unit, it should be understood that the foundation may have two or more independently inflatable units as shown in FIG. 2. In that case, two foundation inflation valves 23A and 23B are provided for independent inflation.

Turning to FIG. 3, there is shown an exploded view of air bed 11. More particularly, air mattress 15 is shown in exploded form, while air mattress 13 (which is preferably of identical construction) is not. The other portions of air bed 11 in FIG. 3 are also shown in exploded form. As can be seen in FIG. 3, air mattresses 13 and 15 share a common top 29. It is preferred that top 29 be flocked to help keep bedding in place on air bed 11. It should be understood that air mattresses 13 and 15 need not share a common top if the additional costs of separate tops and a common cover can be justified.

Figure 4:
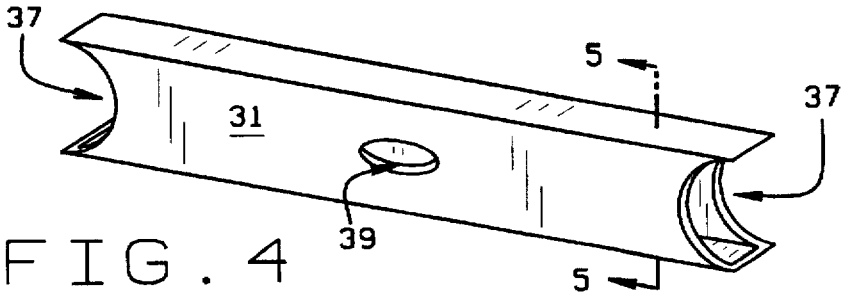
FIG. 4 is a perspective view of a partition used in the air bed of FIG. 1.
Figure 5:
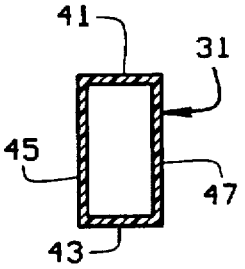
FIG. 5 is a cross sectional view taken along lines 5—5 of FIG. 4.

Air mattresses 13 and 15 each have a plurality of partitions 31 extending across its width as shown in FIG. 3. The partitions are secured to both top 29 and a bottom 33 of the respective air mattress. The partitions define a plurality of compartments therebetween, and their structure substantially reduces any jostling motion caused by a person sitting upon a mattress or moving around on a mattress. The partitions are preferably of the looped construction shown in FIGS. 4 and 5. As can be seen in these figures, the partitions are hollow but have openings 37 at their ends and openings 39 in the middle which allow air to flow from compartment to compartment as force is applied to the mattress. Each partition is preferably welded at its top 41 and its bottom 43 to the corresponding top and bottom of the mattress (13 or 15 as applicable). This welded seem runs horizontally and is preferably about ½" is width for each partition. This partition design provides greater seam surface area and two walls (45 and 47) for added containment and strength.

Turning back to FIG. 3, it can be seen that foundation 21 also includes a plurality of similar partitions 51 which extend across the width of the foundation. Partitions 51 are substantially the same as partitions 31 in structure, although they are preferably of greater length as required by the greater width of the foundation. Moreover, partitions 51 need not be the same height as air mattress partitions 31—they may be the same, shorter or taller as desired.

As can be seen in FIG. 3, foundation 21 has a top 55 which is a separate piece from mattress bottoms 33. This structure helps isolate the air mattresses from each other. Top 55, foundation side 57, partitions 51, and foundation bottom 59 (and all the parts of the air bed) are preferably vinyl and secured together as described herein by welding in the conventionally known manner.

In FIG. 3, belt 25 is shown to extend circumferentially around the air bed 11 and to be of sufficient size to allow it to be welded to top 29 and foundation bottom 59. However, belt 25 is not directly welded to either the air mattresses or to the side 57 of the foundation. This structure again promotes isolate of the various components of the air bed to prevent jostling.

In view of the above, it will be seen that all the objects and features of the present invention are achieved, and other advantageous results obtained. The description of the invention contained herein is illustrative only, and is not intended in a limiting sense.

I claim:

1. An air bed comprising:

first and second air-tight enclosures disposed side by side in a first plane, each of the first and second air-tight enclosures being independently inflatable and having substantially the same length and width, the first and second air-tight enclosures together having a first cross-sectional area in the first plane;

an inflatable foundation disposed below said first and second air-tight enclosures in a second plane substantially parallel to said first plane, said inflatable foundation having a cross-sectional area in the second plane at least as great as the first cross-sectional area, said foundation being independently inflatable with respect to the first and second air-tight enclosures;

means for securing the first and second air-tight enclosures and the inflatable foundation together with the first and second air-tight enclosures fixed in place with respect to the inflatable foundation, said securing means including a circumferential belt having a height sufficient to extend from the bottom of the inflatable foundation to the top of the first and second air-tight enclosures.

2. The air bed as set forth in claim 1 wherein the inflatable foundation consists of a single inflatable unit.

3. The air bed as set forth in claim 1 wherein the inflatable foundation includes at least two independently inflatable units.

4. The air bed as set forth in claim 1 wherein the first and second air-tight enclosures share a common top.

5. The air bed as set forth in claim 1 wherein each of the first and second air-tight enclosures has therein a plurality of partitions extending across its width, said partitions being secured to both a top and a bottom of the respective air-tight enclosure and defining a plurality of compartments therebetween.

6. The air bed as forth in claim 5 wherein the partitions are in the shape of loops extending across the width or their respective air-tight enclosures.

7. The air bed as set forth in claim 6 wherein the loops have openings therein to allow the controlled passage of air from compartment to compartment.

8. The air bed as set forth in claim 1 wherein the inflatable foundation includes a top and a bottom and a plurality of partitions extending across its width, said partitions defining a plurality of compartments therebetween.

9. The air bed as set forth in claim 8 wherein the partitions are in the shape of loops, said loops having openings therein to allow the controlled passage of air from one compartment to another in the inflatable foundation.

10. The air bed as set forth in claim 9 wherein the first and second air-tight enclosures also include loop-shaped partitions defining a plurality of compartments therein.

11. The air bed as set forth in claim 10 wherein the partitions of the inflatable foundation are not the same height as those of the first and second air-tight enclosures.

12. The air bed as set forth in claim 8 wherein the top of the inflatable foundation is adjacent to but a separate piece from any portion of the first and second air-tight enclosures.

13. The air bed as set forth in claim 1 wherein the circumferential belt is welded to said bottom and to said top.

14. The air bed as set forth in claim 1 further including at least one venting hole from the exterior to the interior of the circumferential belt to allow air flow into and out of the air bed without deflating either the air-tight enclosures or the inflatable foundation.

15. The air bed as forth in claim 1 wherein at least the top of the air bed is flocked vinyl.

16. The air bed as set forth in claim 1 wherein each of the air-tight enclosures and the inflatable foundation has its own filling valve, said filling valves having means to inhibit reverse air flow out of the air bed during inflation.

* * * * *